United States Patent [19]

Rines et al.

[11] 4,447,168

[45] May 8, 1984

[54] BOTTOM MARGIN INDICATOR APPARATUS FOR TYPEWRITERS AND THE LIKE

[76] Inventors: Carol M. Rines, 13 Spaulding St., Concord, N.H. 03301; Duane Marshall, 9 Hadley Rd., Lexington, Mass. 02173

[21] Appl. No.: 281,084

[22] Filed: Jul. 7, 1981

[51] Int. Cl.[3] ..... B41J 29/18

[52] U.S. Cl. ..... 400/708

[58] Field of Search ..... 400/708, 706, 711, 712, 400/647; 250/556, 548, 561, 223 R

[56] References Cited

U.S. PATENT DOCUMENTS

| | | | |
|---|---|---|---|
| 3,861,511 | 1/1975 | Nelson et al. | 400/161.1 |
| 3,981,388 | 9/1976 | Guiliani | 400/706 |
| 4,014,427 | 3/1977 | Rines | 197/189 |
| 4,257,712 | 3/1981 | McGuire | 400/706 |
| 4,272,204 | 6/1981 | Quinn, Jr. et al. | 400/708 |
| 4,302,681 | 11/1981 | Woodsford et al. | 250/556 |

*Primary Examiner*—Robert A. Hafer
*Assistant Examiner*—Bradley M. Lewis
*Attorney, Agent, or Firm*—Rines & Rines, Shapiro & Shapiro

[57] ABSTRACT

This disclosure is concerned with improved bottom-edge margin indicators for typewriter paper and the like using an optical sensor-monitor wherein spurious effects of the edge of the paper exiting from the bottom margin sensor region and pre-printed material thereon are obviated, and in which the sensor-monitor of the bottom edge of the paper is preferably carried by the platen shield itself in manner that is particularly advantageous for optical sensing of the paper, with the sensor maintained in extremely closed proximity to the paper irrespective of its thickness, and adapted for simple and ready adjustment, if desired, to vary the margin setting.

8 Claims, 4 Drawing Figures

BOTTOM MARGIN INDICATOR APPARATUS FOR TYPEWRITERS AND THE LIKE

The present invention relates to bottom margin indicator apparatus for typewriters and the like.

In U.S. Pat. No. 4,014,427 of co-applicant Carol M. Rines herein, improved apparatus is disclosed for sensor-monitoring the bottom edge of the paper within a typewriter, preferably off-center toward the side, and for effecting adjustable calibration settings near a side of the platen; and earlier proposals are described in the other patents referred to in said Letters Patent. The restriction on location of the sensor and the specialized equipment modification and nature of adapting these techniques for inexpensive and simple retrofitting or remodification of existing typewriter models by the secretary or unskilled operator have, however, constituted problems in rendering these improvements readily useable commercially with universal applicability. It is to the solution of these and related problems, accordingly, that the present invention is primarily directed.

An object of the invention, therefore, is to provide a new and improved bottom margin indicator that shall not be subject to the above-described and similar disadvantages; but that, to the contrary, provides for a much more simplified modification of existing typewriter components—in particular, only a part of the paper shield structure—, and the provision of a retrofit therefor that can be installed by unskilled hands, and that, indeed, can be identically used as part of the original equipment as manufactured and assembled, as well.

A further object is to provide such a novel margin indicator that is particularly and preferably, though not exclusively, adapted for typewriters with axially immobile platens and paper shields, as of the electric ball printing head type.

An additional object is to provide such an indicator in which spurious signal effects caused by optical noise effects produced as the bottom edge of the paper passes the sensing region or by pre-printed material are obviated; such improvement being particularly useful with the preferred retrofit structure of the invention, but also more generally useful with other types of margin and similar indicators wherein such problems are encountered.

Other and further objects are explained hereinafter and more particularly delineated in the appended claims.

In summary, however, from one of its important aspects, the invention embraces bottom margin indicator apparatus for typewriter paper and the like operating with typewriters having a platen rotatable about its axis and around a cylindrical surface of which the paper is advanced in a transverse path during typewriting, said apparatus having, in combination, cylindrical-section paper shield means mountable below the platen and between the upper surface of which and the platen the paper is thus advanced; said shield means being provided with aperture means the edges of which comprise a track; photo-sensitive monitor means mounted within an assembly block provided with means for positioning and maintaining the assembly at a predetermined region of the track and with the monitor means there-exposed through the aperture means, said assembly block holding the monitor means in close proximity to the said upper surface of the shield but not substantially above the same and with the assembly itself disposed below said surface in order to position the monitor means substantially at said surface and thus in non-interfering relationship with, but in closest proximity to, the paper passed between the same and the platen irrespective of the thickness of the paper; signaling means connected to and responsive to the sensing by the monitoring means of the absence of paper at said predetermined region following the presence of paper thereat for providing an indication of the advent of such absence: and means for electrically powering the monitor and signaling means. From a further point of view, the invention also embraces means for obviating spurious signaling caused by noise effects as the bottom edge of the paper exits from the region of the monitor means. Preferred details and best mode embodiments are hereinafter set forth.

The invention will now be described with reference to the accompanying drawing, FIG. 1 of which is a plan view of the portion of a cylindrical paper shield equipped with the preferred construction of the invention;

Figure 1:
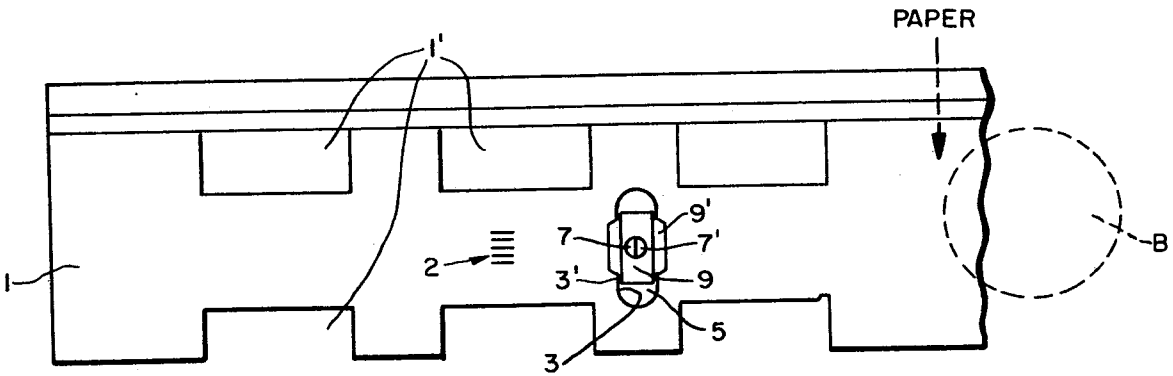

Referring to the drawings, the invention is illustrated, FIG. 1, in connection with its specific preferred, though not exclusive, application to the said ball printing head (B) type typewriter, with the longitudinally axially immobile paper or platen cylindrical-section shield shown at 1 adapted to receive paper between its upper surface and the similarly immobile platen thereabove (not shown), between which the typewriter paper is advanced in a transverse path during typewriting, as schematically indicated by the dotted arrow labelled "PAPER". The shield is shown with conventional apertures 1′ for the paper rollers conventionally mounted thereunder.

In accordance with the present invention, and without the before-mentioned restrictions of the systems of the said earlier Letters Patent, the paper shield is provided with a simple modification; namely, a transverse depression 3 that is apertured at 5 with a transverse slot, preferably to the side of the central region of the shield as shown. The edges of the aperture 5 at the side walls 3′ of the depression 3 serve as a track for the mounting and securing of the monitor sensor 7–7′ that is to monitor the bottom margin of the paper as it passes between the upper shield surface 1 and the platen, giving a signal warning, as by a buzzer or other indicator 4 (FIG. 2) energized by a signaling circuit 8 responsive to the monitor sensor 7–7′ via conductors 6, indicative of the fact that the desired bottom margin has been reached, as generally explained in said Letters Patent.

In the preferred embodiment, the monitor sensor is in the form of a combined photo-emitter 7 and photo-receiver 7′ that respectively transmit light to the paper and receive reflections therefrom so long as it is present, producing a change of signal when the absence of paper is indicated by the sensing of the black platen. The monitor sensor 7–7′ is shown centrally held just below or substantially in line with the upper surface of the shield by the lower portion of an assembly block, preferably comprising a depending U-shaped resilient clip fixture 9 with orientation means, such as top lips or flanges 9' that extend laterally over and ride upon the track 3' of the shield depression 3, with the unit 7–7'–9 depending within the slot 5. This enables secured resilient clipping or clamping engagement that locks or maintains the monitor sensor 7–7' at the desired predetermined region of the aperture 5. The unskilled operator can readily force-slide the assembly block clip fixture 9 with its central monitor sensor 7–7' along the slot edges 3' to other desired predetermined regions of the aperture 5, as indicated, for example, in FIG. 1 by the illustrated calibration marks 2, representing a varied or different preselected bottom margin.

Figure 2:
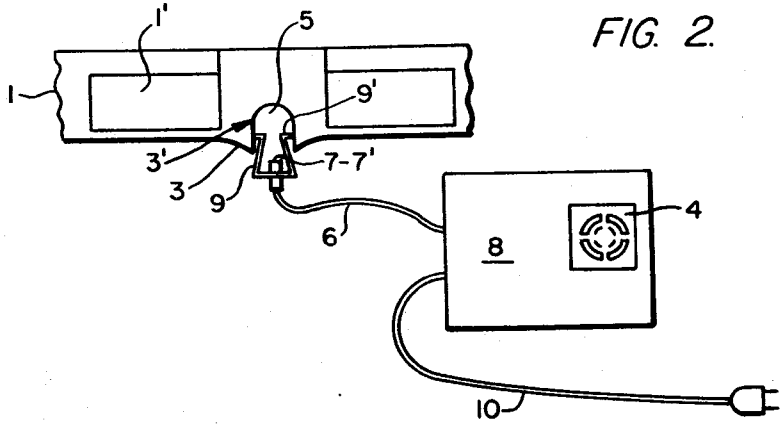
FIG. 2 is a fragmentary side elevation of the optical monitor region of the shield.

The signaling circuit 8 and audible signal buzzer or other indicator means 4 may be in a separate package as shown in FIG. 2, or it may be located attached to the photo sensor assembly 7–7'–9 for economy of manufacture and installation. Power may be obtained from a power cord 10 or by a probe-type connection for tapping into the power-carrying cord of the typewriter, if electric.

Figure 3:
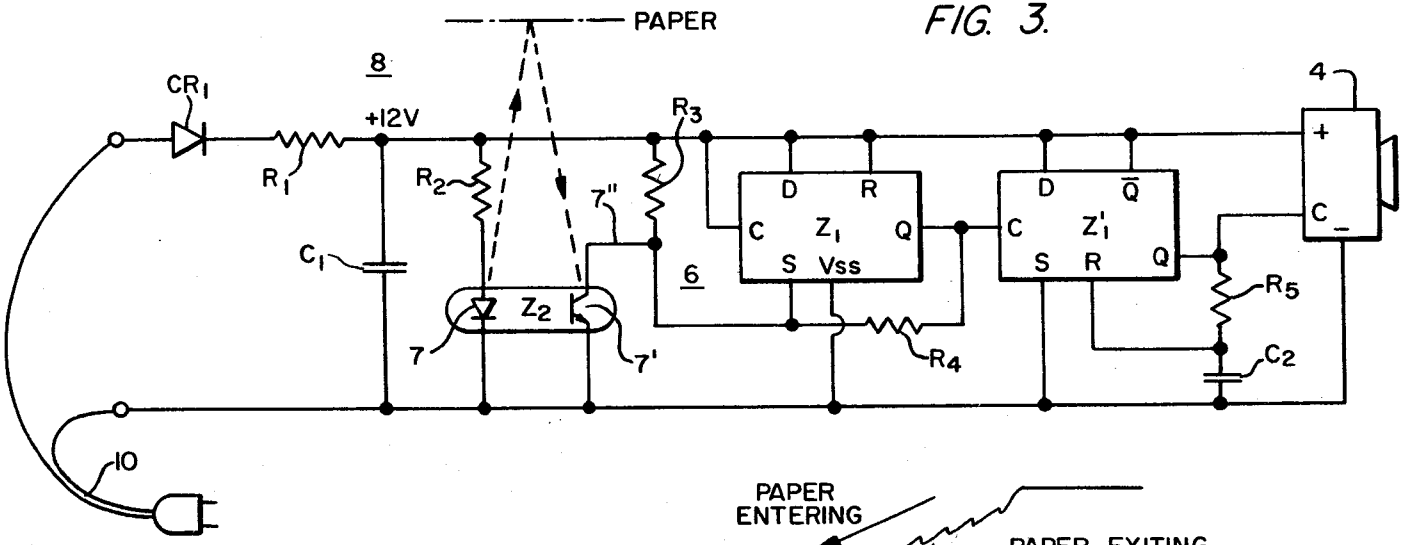
FIG. 3 is a diagram of a preferred electronic system for the monitor and signaling means, including more generally applicable paper edge noise-effect suppressing circuits.

A preferred signaling circuit 8 is shown in FIG. 3 responsive to the sensor's indication of the passing of the sheet beyond the monitoring predetermined region of the aperture 5, corresponding to the desired bottom margin, and producing, for example, an audible signal tone indication at the buzzer or other indicator 4. In this circuit, the a.c. power applied at 10 is rectified by the rectifier $CR_1$ into a d.c. supply voltage, say 12 volts, stored through series resistor $R_1$ in the shunt capacitor $C_1$. The light-emitter diode section 7 of the monitor sensor 7–7' and the light-sensitive receiver section 7' are connected, respectively through resistors $R_2$ and $R_3$, between the +12 V and "ground" side of the voltage supply, shining light upward through the aperture 5 towards the place where the paper passes, as shown in dotted lines, and receiving one kind of reflection signal back from the paper, if it is present, and a very different reflection signal from the dark platen in the absence of paper. The emitter-receiver 7–7' is shown at $Z_2$ in a common envelope, such as the Optronics Type 710 reflective-coupled photo emitter-receiver.

Figure 4A:
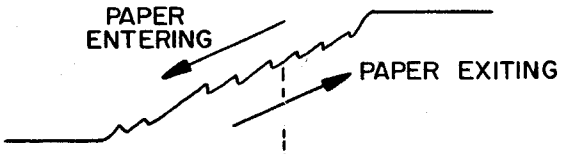
FIGS. 4A, 4B, and 4C are wave-form diagrams of the operation of the spurious-signal obviating circuit of FIG. 3.

The output 7'' of the photo receiver 7' is applied to an integrated circuit shown as $Z_1$–$Z_1'$ comprising half of a Schmidt trigger circuit and a one-shot pulse circuit, such as a Type 4013 integrated circuit (CMOS Dual D flip-flop). The Q output of the Schmidt trigger section $Z_1$ (having input from 7' applied at S and with pins C, D and R connected to the +12 V terminal) is fed to the C pin of $Z_1'$ in conventional Schmidt trigger circuit fashion. The Q output of the one-shot section $Z_1'$ is connected to the signal input pin C of the buzzer or other indicator 4, charging capacitor C2 through resistor R5. In effect, a toggle-type flip-flop is provided (Q), to generate and unambiguous buzzer-control pulse signal of predetermined duration, shown in the waveform of hereinafter described FIG. 4C.

Figure 4B:
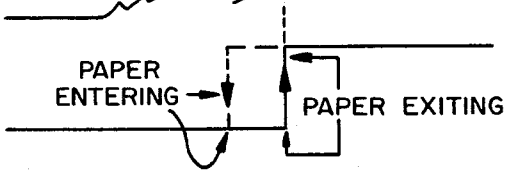
Figure 4C:
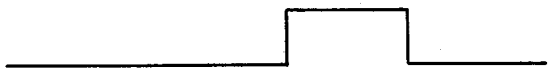

In operation, as the bottom edge of the paper passes out of the region where the light emitted from 7 reflects from the same and generates reflected signals upon the photo receiver 7', or where pre-printed material on the paper may be present, there are spurious noise effects generated at the output 7'' of $Z_2$ which give rise to multiple and ambiguous triggering of the one-shot $Z_1'$ and hence give rise to spurious energizing of the buzzer or other indicator 4. This is indicated by the erratic jagged waveform of FIG. 4A, with the arrows indicating such effects upon paper entering (downward) and paper exiting (upward), as labelled. By employing the hysterisis effect introduced by the bi-stable nature of the half Schmidt trigger circuit $Z_1$, as shown in the waveform of FIG. 4B (Q output of $Z_1$), injecting bias via resistor $R_4$ back to the input, the noise effects and resulting spurious triggering is avoided at the edge of the paper. The data input transferred to the Q output of the one-shot $Z_1'$ latches up by the effective toggle flip-flop action ($Q$-$\overline{Q}$), charging $C_2$ through $R_5$, as before-stated, with resetting upon the reaching of a threshold. The time constant involving $C_2$ and $R_5$ thus controls a definitively triggered unambiguous independently generated signal output pulse at Q (FIG. 4C), independent of noise effects received at 7', for driving the buzzer 4 for the predetermined duration of the output pulse of FIG. 4C.

Suitable circuit values with the Optronics 710 sensor $Z_2$ and the 4013 integrated circuit $Z_1$–$Z_1'$, are: $R_1$=5K; $CR_1$–1N4002 type; $R_2$=1K; $R_3$=22K; $R_5$=1M; $C_2$=5 μf. For such operation, the duration of the output pulse of FIG. 4C will be of the order of about 0.4 second. Clearly this technique for removing spurious edge signals is useful with other types of margin or related sensor systems, though particularly advantageous with the shield-mounted preferred structure of FIGS. 1 and 2. Other types of indicators and signal driving circuits therefor may also be used, as discussed, for example, in said Letters Patent.

Thus, an extremely effective and simple installation is provided, with minimal change of existing typewriter components, and with no limitation on position of the monitoring slot region, and with the added advantage that, the sensor is held in as close proximity to the upper surface of the shield and thus the paper as possible (with the assembly block clip fixture 9, depending below said surface on its underside) without mechanically interfering with the passage of the paper, and universally effective with any thickness of paper, as accomodated by the resiliency of the platen. Obviating or suppressing of spurious edge signals is also effected.

While it is preferred thus to modify the existing type shield, clearly an equivalent attachment to a shield that effects the same results could be used; and the apparatus is also readily carried by moving typewriter carrier versions, as well; such and other modifications readily occuring to those skilled in this art and being thus considered to fall within the spirit and scope of the invention as defined in the appended claims.

What is claimed is:

1. In combination, bottom margin indicator apparatus and a typewriter having a platen rotatable about an axis, said platen having a cylindrical surface, a cylindrical-section paper shield mounted immediately below the platen so that paper is advanced along a path transverse to said axis during typewriting between an upper surface of the shield and the platen; said shield being provided with an aperture extending transversely of the shield, the edges of the aperture comprising a track; said apparatus having photo-sensitive monitor means for sensing the presence and absence of paper, said monitor means mounted within an assembly block provided with means for slideably supporting the assembly block on the track for movement transverse of the shield and for positioning the assembly block at a predetermined region of the track, suspended therefrom, and with the monitor means there-exposed through the aperture, said assembly block holding the monitor means in close proximity to the said upper surface of the shield but not substantially above the same and the assembly block itself being disposed below said surface in order to position the monitor means substantially at said surface and thus in noninterfering relationship with, but in closest proximity to, the paper passed between the same and the platen irrespective of the thickness of the paper; signaling means connected to and responsive to the sensing by the monitor means of the absence of paper at said predetermined region following the presence of paper thereat for providing an indication of such absence; means for electrically powering the monitor and signaling means; and means for preventing spurious signals from being applied to said signaling means that would effect spurious and multiple indications as the bottom edge of the paper passes by the monitor means.

2. The combination as claimed in claim 1 and in which said photo-sensitive monitor means comprises photo-emitting and photo-receiving means oriented respectively to transmit light to paper at said surface and to receive reflections therefrom.

3. The combination as claimed in claim 2 and in which said aperture is disposed within a depression formed in said shield with the edges of the aperture being disposed in walls of the depression.

4. The combination as claimed in claim 3 and in which said assembly block comprises an upper portion riding along said walls of the depression and a lower portion riding along the underside of the shield depression.

5. The combination as claimed in claim 1 and in which said means for slideably supporting the assembly block comprises resilient means for engaging the edges of the aperture.

6. The combination as claimed in claim 1 and in which said platen and paper shield are immobile along their axis and said typewriter is of the type having a ball printing head, with the said monitor means thus similarly held immobile by the shield.

7. The combination as claimed in claim 1 and in which said spurious signal preventing means comprises means employing a hysteresis effect for generating an unambiguous signal in said signaling means following exiting of said paper from said region.

8. The combination as claimed in claim 7 and in which said means employing said hysteresis effect comprises a Schmidt circuit responsive to the output of said monitor means coupled to a one-shot circuit for generating said signal as a pulse of predetermined duration.

* * * * *